US007948336B2

(12) United States Patent
Park

(10) Patent No.: US 7,948,336 B2
(45) Date of Patent: May 24, 2011

(54) MOLD CASED CIRCUIT BREAKER

(75) Inventor: Jin Young Park, Chungcheonbuk-do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 1104 days.

(21) Appl. No.: 11/686,723

(22) Filed: Mar. 15, 2007

(65) Prior Publication Data

US 2007/0215577 A1 Sep. 20, 2007

(30) Foreign Application Priority Data

Mar. 17, 2006 (KR) ..... 20-2006-0007250 U

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 53/00*** | (2006.01) |
| ***H01H 3/00*** | (2006.01) |
| ***H01H 9/44*** | (2006.01) |
| ***H01H 33/18*** | (2006.01) |

(52) U.S. Cl. ..... 335/16; 335/147; 335/195; 218/22

(58) Field of Classification Search ..... 335/6, 147, 335/195; 218/22

See application file for complete search history.

(56) References Cited

U.S. PATENT DOCUMENTS

| | | | | |
|---|---|---|---|---|
| 4,255,732 | A * | 3/1981 | Wafer et al. | 335/16 |
| 4,713,640 | A * | 12/1987 | Murphy et al. | 335/194 |
| 4,906,967 | A * | 3/1990 | Winter | 335/172 |
| 5,023,583 | A * | 6/1991 | Bratkowski et al. | 335/195 |
| 5,223,681 | A * | 6/1993 | Buehler et al. | 218/22 |
| 5,466,903 | A * | 11/1995 | Faber et al. | 200/400 |
| 5,861,784 | A * | 1/1999 | Heise et al. | 335/20 |
| 5,866,996 | A * | 2/1999 | Navarre | 218/22 |
| 6,239,677 | B1 * | 5/2001 | Ramakrishnan et al. | 335/35 |
| 2002/0175786 | A1 * | 11/2002 | Wellner et al. | 335/16 |

* cited by examiner

*Primary Examiner* — Elvin G Enad
*Assistant Examiner* — Alexander Talpapatskiy
(74) *Attorney, Agent, or Firm* — Lee, Hong, Degerman, Kang & Waimey

(57) ABSTRACT

A mold cased circuit breaker is disclosed that enables a user to easily discern an actually connected state between stationary contactors and movable contactors and forcibly separates a connection therebetween if there arises electrical fault, wherein the circuit breaker comprises: a first isolation link hinged at a lower end thereof to a shaft unit and selectively engaged at an upper end thereof with a lateral surface of a lever; a second isolation link centrally formed with an oblong hole for accommodating a guide pin protruded on a side plate and linked at one end thereof to an upper end of the first isolation link; and an isolation lever adjacently positioned at one end thereof to the other end of the second isolation link, and so positioned at the other end thereof as to selectively engage with a nail, and rotatably mounted at the side plate to rotate the nail by way of operation of the second isolation link.

9 Claims, 6 Drawing Sheets

MOLD CASED CIRCUIT BREAKER

CROSS-REFERENCE TO RELATED APPLICATION

The present application is based on, and claims priority from, Korean Application Number 20-2006-0007250, filed Mar. 17, 2006, the disclosure of which is incorporated by reference herein in its entirety.

BACKGROUND ART

Aspects of the following description are directed to a mold cased circuit breaker (so called abbreviated MCCE) for protecting a circuit against an electrical overload by forcibly interrupting the circuit, and more particularly to a mold cased circuit breaker capable of forcibly separating a contact during a circuit fault by allowing a user to easily notice a state of the contact.

Typically, circuits are disposed at one side thereof with a mold cased circuit breaker for protecting the circuit against an electrical overload.

Referring to FIG. 1, a conventional mold cased circuit breaker incorporates a cover (1), a base (2), a switching mechanism (3) for opening and closing a circuit, a tripping device (4) for detecting a circuit fault, and an arc extinguisher (5) for extinguishing electrical arc jumps generated at contacts during a circuit interruption.

Referring to FIG. 2, the switching mechanism (3) principally incorporates a side plate (111) fixed at a cover, a pair of stationary contactors (112) disposed at a circuit, a lever (113) rotatably disposed at the side plate (111) and formed with a reset pin (113*b*), a handle (114) integrally disposed at an upper end of the lever (113) for displaying each circuit condition and allowing a user to manipulate, a latch (115) limited in a rotating angle by the reset pin (113*b*) to rotate within a predetermined angle, a latch holder (116) selectively restraining the latch (115), a nail (117) controlling the latch holder (116), an upper link (118) rotatably connected to the latch (115), a lower link (119) connected to the upper link (1118), and a shaft unit (122) disposed with a pair of movable contactors (124) selectively connected to the stationary contactors (112) by the operation of the lower link (119).

Referring to FIG. 2, in one aspect of the conventional mold cased circuit breaker, the handle (114) is aligned on a tripped position and the stationary contactors (112) and the movable contactors (124) are separated in a tripped condition, under which there is no particular force that is activating thereon.

If the circuit breaker is reset to completely interrupt the circuit in the tripped state as shown in FIG. 2, the handle (114) is rotated clockwise to allow the circuit breaker to undergo a reset state as shown in FIG. 3. In this case, the circuit breaker is not instantly manipulated into a closed state from a tripped state (The handle is in a closed position, and the stationary contactors and movable contactors are in engagement therebetween. See FIG. 4) for being conducted again, but the circuit breaker is manipulated into a reset state (The handle is in a reset position, and the stationary contactors and movable contactors are in the state of being engaged) before being manipulated into a closed state.

If the handle (114) is rotated clockwise to be in a state as shown in FIG. 3, the reset pin (113*b*) of the lever (113) rotates the latch (115) to cause a right end of the latch (115) to go downward, where the upper link (118) and the lower link (119) are rotated at the same time. At this time, current still does not flow as the lower link (119) is hinged only to a shaft unit (122), whereby the shaft unit (122) is not rotated.

If the circuit breaker is manipulated into a closed state for being conducted, i.e., if the handle (114) is rotated counterclockwise to be positioned in a closed state and the stationary contactors and movable contactors are in the state of being engaged, current flows as the circuit breaker comes to be in such a state as shown in FIG. 4. The latch (115) in a reset state (when the circuit is interrupted) as shown in FIG. 3 cannot be activated even if the handle (114) is completely moved counterclockwise as the latch (115) is in a state of being restrained within the latch holder (116). However, if the handle (114) is moved counterclockwise as illustrated in FIG. 4, a main spring of the lever (113) pulls a toggle pin (120) to rotate the lower link (119) counterclockwise and to rotate the shaft unit (122), whereby the stationary contactors and movable contactors are in the state of being engaged to allow the current to flow.

If the mold cased circuit breaker is in a normal state, and when the handle (114) is forced to rotate clockwise as depicted in FIG. 4, the stationary contactors (112) and movable contactors (124) should not maintain a state where both contactors (112, 124) are engaged as shown in FIGS. 5 and 6.

In other words, if the handle (114) is in a closed position and is rotated clockwise to allow the molded case circuit breaker to be in a tripped state or in a reset state while the stationary contactors (112) and movable contactors (124) maintain a state where both contactors (112, 124) are engaged as shown in FIG. 4, the movable contactors (124) must rotate to separate themselves from the stationary contactors (112). In other words, if the stationary contactors (112) and movable contactors (124) are in the state of being engaged, the handle (114) should not be in a tripped position as shown in FIG. 5, or the handle (114) should not be in a reset position as shown in FIG. 6.

For example, as illustrated in FIG. 5, the stationary contactors (112) and movable contactors (124) may be in a fused-like state by an accident current or may not be separated due to other causes to allow the handle (114) to be positioned on a reset state, but the stationary contactors (112) and movable contactors (124) may be in a state of being engaged. However, if the stationary contactors (112) and movable contactors (124) are in a state of being engaged, the handle (114), which is a means for indicating a circuit state, should not be in a tripped position or a reset position.

Even if the handle (114) is rotated to a state shown in FIG. 5, but is nonetheless unable to separate the stationary contactors (112) from the movable contactors (124), the handle (114) may indicate a reset position indicative of a circuit being opened, but the stationary contactors (112) and movable contactors (124) are in fact engaged for being in a conductive state. Under this circumstance, if an operator happens to work on the circuit, assuming that the circuit is not in a conductive state based on a fact that the handle (114) is in a reset position, the operator may be struck by electricity during the work.

In a nutshell, if the stationary contactors (112) and movable contactors (124) are not separated due to a fused-like engaged state and if the handle (114) indicates a tripped position or a reset position, the stationary contactors (112) and movable contactors (124) should be forcibly separated, but the conventional mold cased circuit breaker thus described suffers from a drawback that an actual circuit state and a handle-indicating state are different to thereby cause a safety failure problem.

SUMMARY

Therefore, the present disclosure is directed to solve the above-mentioned problems, and has for one object thereof to provide a mold cased circuit breaker of enhanced interruption performance and reliability by implementing a forced tripping in case a circuit becomes faulty.

Another object is to provide a mold cased circuit breaker configured to allow a user to discern an actually connected state between stationary contactors and movable contactors.

In one general aspect, a mold cased circuit breaker comprises: a pair of stationary contactors respectively connected to a power source side and a load side within a base on a point symmetric alignment; a pair of side plates each spaced at a predetermined distance apart on the base with the stationary contactors being positioned therebetween; a lever secured at a top end thereof with a handle, rotatably mounted on the side plates and manipulated in a closed state, a tripped state and a reset state; a latch rotatably mounted at one end thereof on the side plates, and rotated by the lever if the lever moves to a reset condition; a latch holder rotatably mounted on the side plates and selectively restraining the other end of the latch; a nail rotatably mounted on the side plates, resiliently supported to the side plates and selectively restraining the latch holder; a shaft unit mounted with movable contactors selectively connected at both ends thereof to the stationary contactors by rotation, discretely arranged from the lever at a lower section of the lever, and rotatably mounted between the pair of the stationary contactors; an upper link hinged at an upper end thereof to the latch; a lower link hinged at an upper end thereof to a lower end of the upper link via a toggle pin, and hinged at a lower end thereof to the shaft unit; a main spring secured at an upper end thereof to an upper end of the lever and secured at a lower end thereof to the toggle pin; and contactor separation means separating the movable contactors from the stationary contactors by cooperating with the lever if the movable contactors and the stationary contactors are engaged.

Implementations of this aspect may include one or more of the following features.

The contactor separation means comprises: a first isolation link hinged at a lower end thereof to the shaft unit and selectively engaged at an upper end thereof with a lateral surface of the lever; a second isolation link centrally formed with an oblong hole for accommodating a guide pin protruded on the side plate and linked at one end thereof to an upper end of the first isolation link; and an isolation lever adjacently positioned at one end thereof to the other end of the second isolation link, and so positioned at the other end thereof as to selectively engage with the nail, and rotatably mounted at the side plates to rotate the nail by way of operation of the second isolation link.

The first isolation link is formed at an upper end of the first isolation link with a lug contacting a lateral surface of the lever when the lever is rotated to a reset position.

The shaft unit is preferably composed of a disc rotatably mounted on the side plate, movable contactors laterally mounted at the disc and selectively engaged at both ends thereof with the pair of stationary contactors by rotation, and a pair of rods mounted relative to a rotation center of the disc by penetrating the disc and the movable contactors.

The pair of rods includes a first rod that comes adjacent to the handle if the handle is placed in a closed position, and a second rod symmetrically arranged relative to a rotation center of the first rod, wherein the lower link is pierced at a lower end thereof by the first rod, and the first isolation link is pierced at a lower end thereof by the second rod.

The latch holder restrains the other end of the latch when the latch is rotated downward at the other end by the lever.

The nail restricts the latch holder when the latch holder restrains the latch. The nail releases the latch holder by rotation of the isolation lever.

Preferably, a lever pin is mounted at a lower end of the lever for connecting the lever to the side plate, and the side plate is mounted with a latch pin for connecting one end of the latch and the side plates, and toggle pin is positioned between the lever pin and the latch pin when the lever is moved to a closed position.

The upper link is lopsidedly formed with a stopper toward the latch pin for preventing the upper link and the lower link from being positioned on a straight line and for supporting the upper link.

BRIEF DESCRIPTION OF THE DRAWINGS

The accompanying drawings, which are included to provide a further understanding of the present description and are incorporated in and constitute a part of this specification, illustrate embodiments of the disclosure and together with the description serve to explain the principles of the present disclosure.

DETAILED DESCRIPTION

Reference will now be made in detail to exemplary embodiments of the present disclosure, embodiments of which are illustrated in the accompanying drawings.

Figure 1:
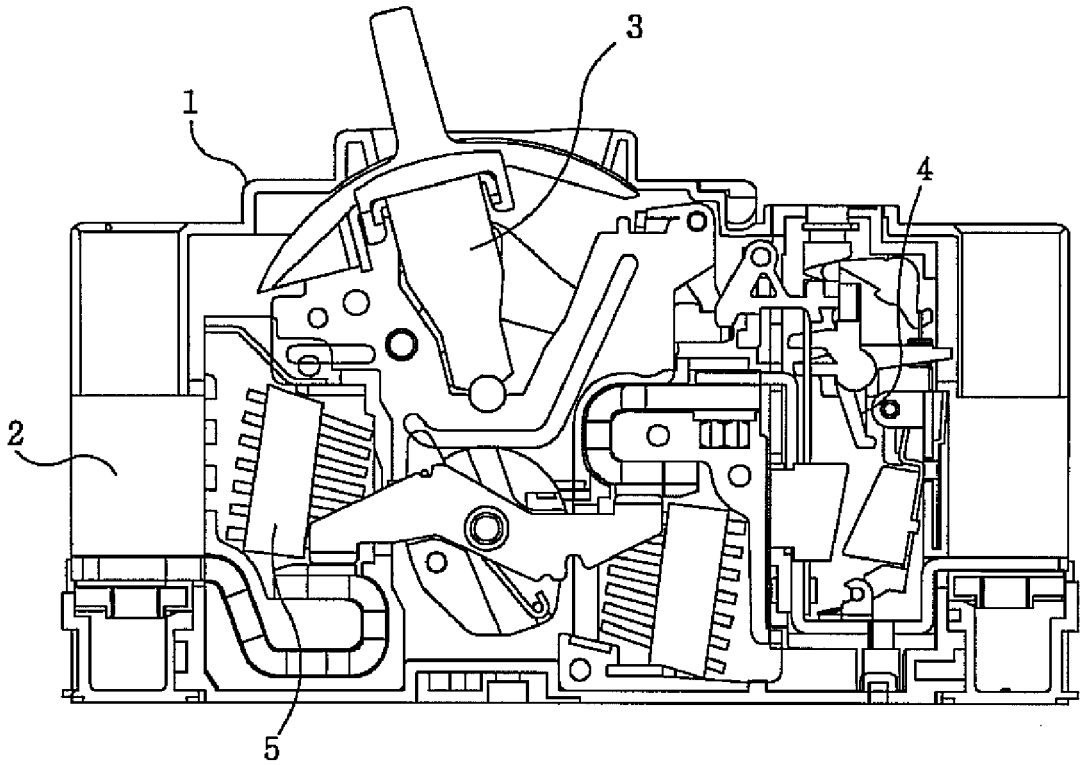
FIG. 1 is a cross-sectional view illustrating a structure of the conventional mold cased circuit breaker.
Figure 2:
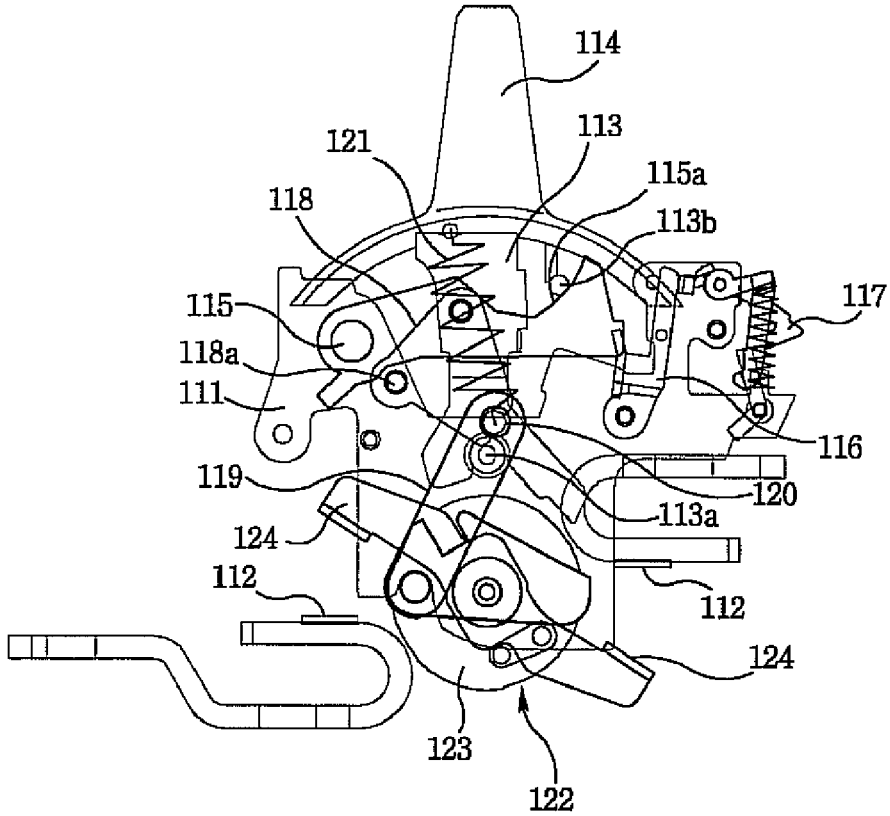
FIG. 2 is a plan illustrating a tripped state of a mold cased circuit breaker according to the prior art.
Figure 3:
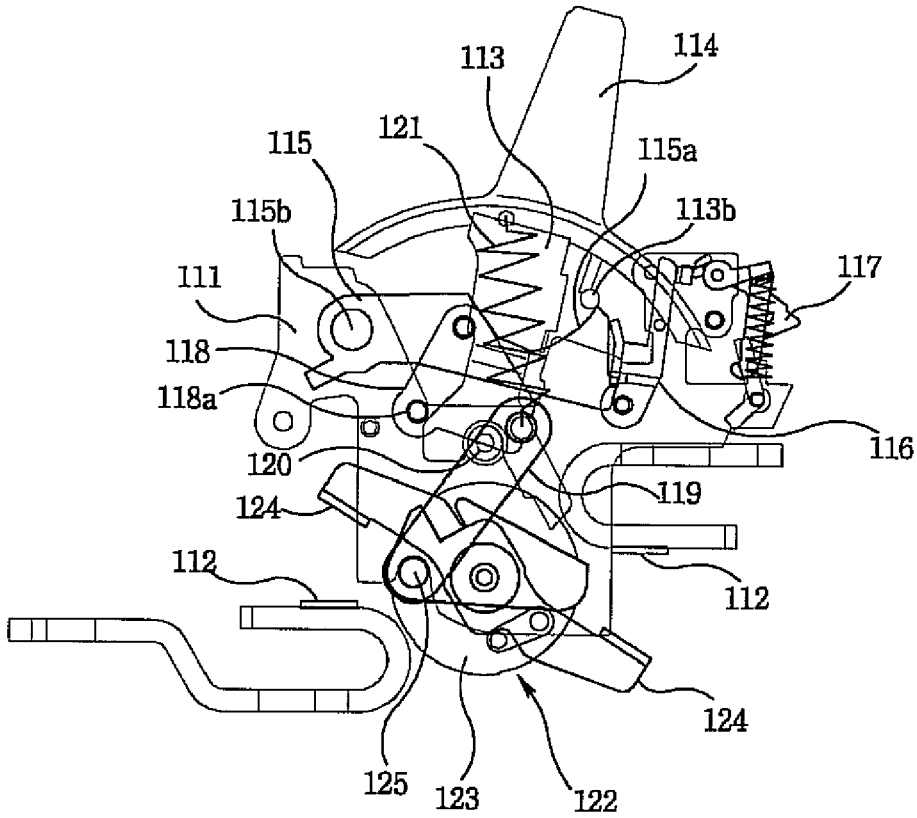
FIG. 3 is a plan illustrating a reset state of a mold cased circuit breaker according to the prior art.
Figure 4:
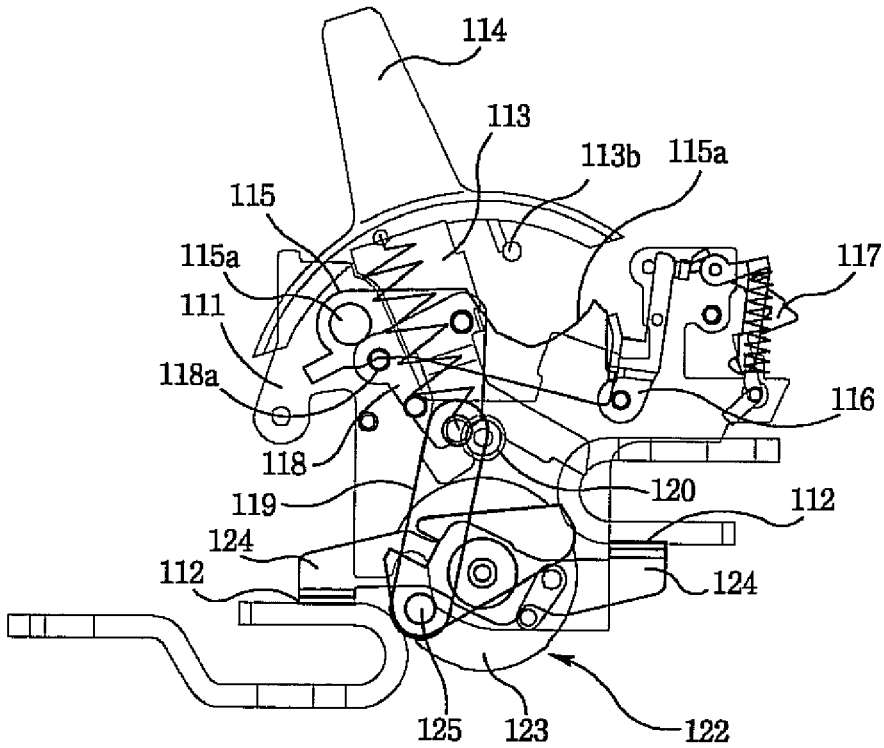
FIG. 4 is a plan illustrating a closed state of a mold cased circuit breaker according to the prior art.
Figure 5:
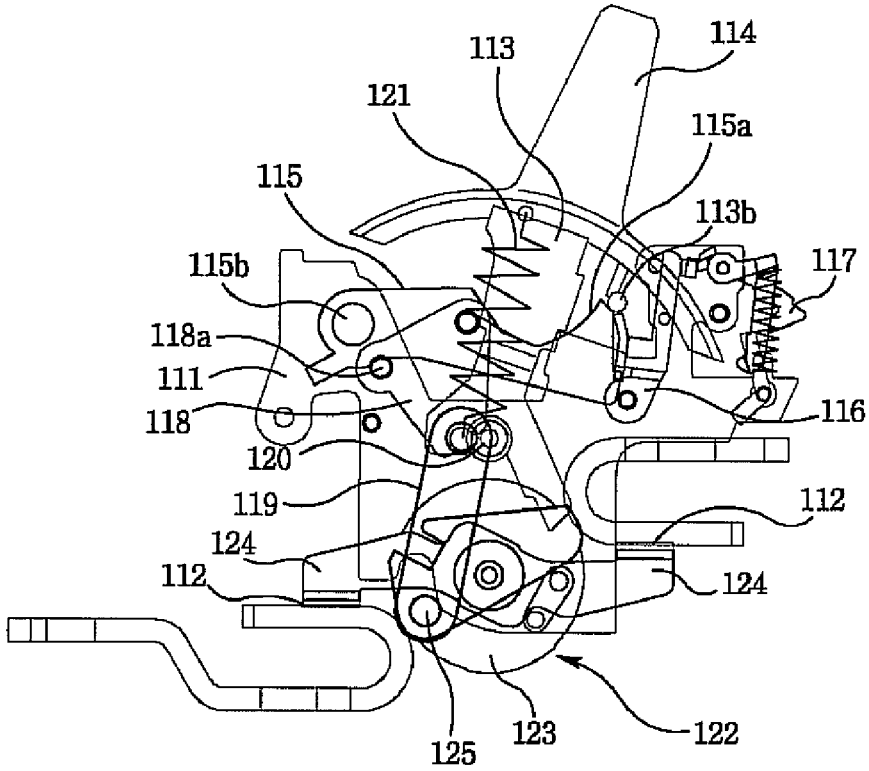
FIGS. 5 and 6 illustrate plan where movable contactors and stationary contactors are closed engaged.
Figure 6:
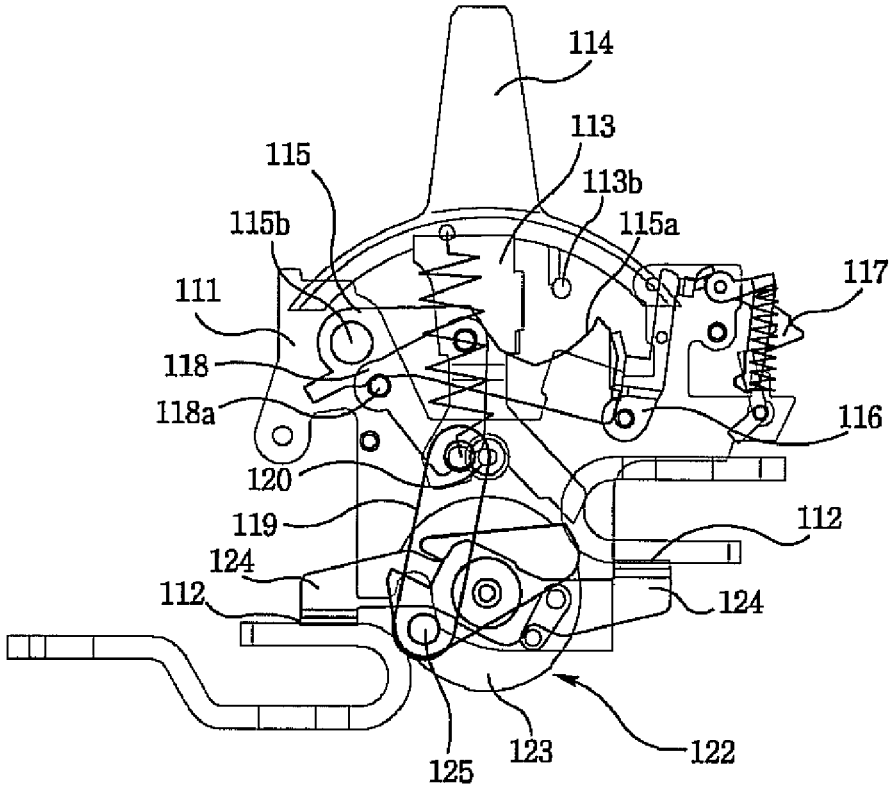
Figure 7:
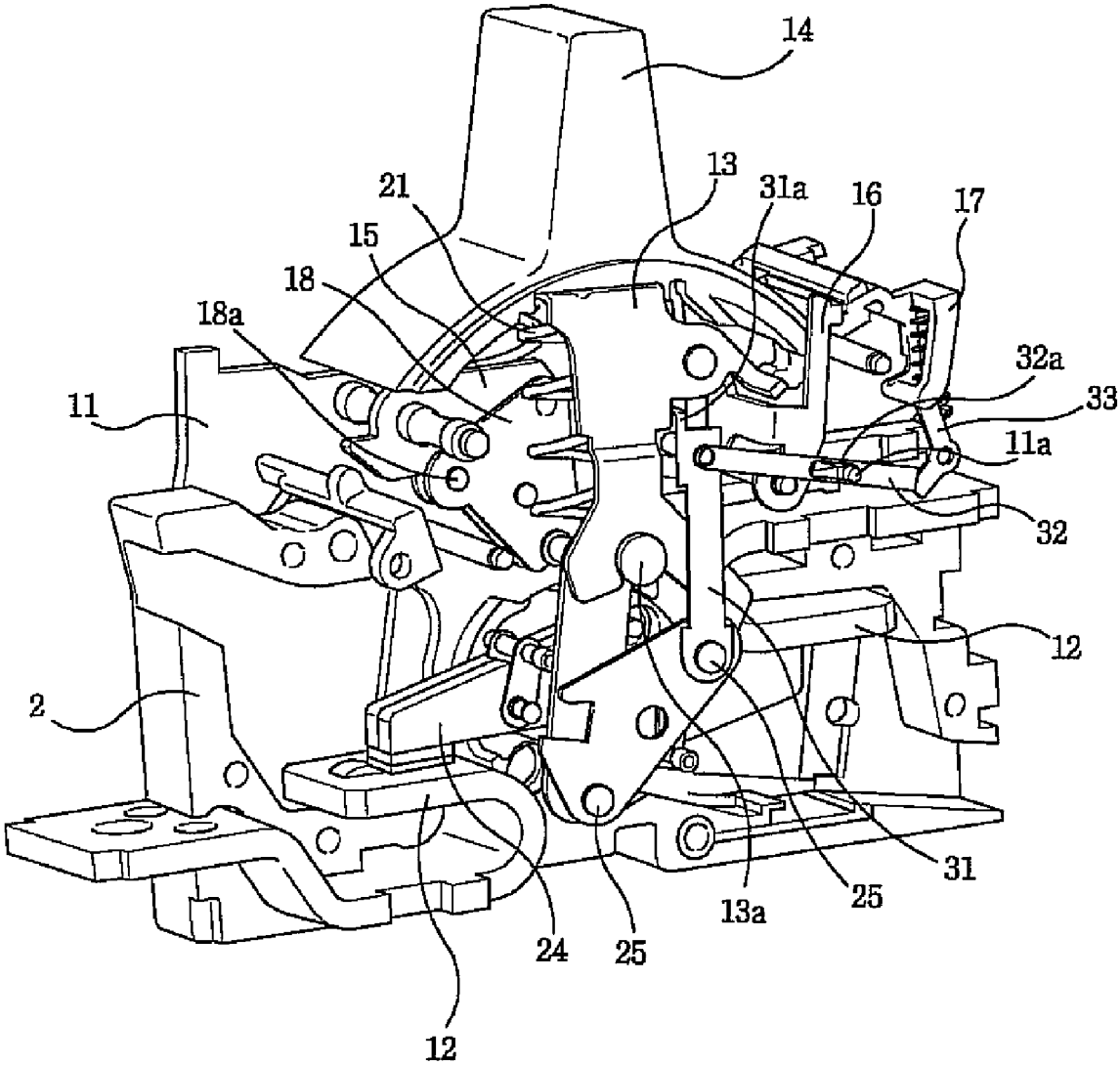
FIG. 7 is a perspective view of principal parts of a mold cased circuit breaker.

Referring to FIG. 7, a mold cased circuit breaker is configured with a contactor separation means for forcibly separating movable contactors and stationary contactors when these two contactors are tightly engaged, where the mold cased circuit breaker is comprised of a base mounted with a pair of stationary contactors and side plates, a lever connected thereon with a handle and rotatably mounted at the side plates, a latch rotatably mounted at the side plates so as to be selectively restrained by a latch holder, a nail selectively restraining the latch holder, an upper link hinged to the latch, a shaft unit including movable contactors contacting the stationary contactors disposed at the base and rotated by the side plates, a lower link hinged thereon to the upper link using a toggle pin and hinged thereunder to the shaft unit, and a main spring connected at one end thereof to an upper end of the lever, and connected at the other end thereof to the toggle pin.

The contactor separation means incorporates a first isolation link (31) hinged at a lower end thereof to the shaft unit (22) and formed thereon with a lug (31*a*), a second isolation link (32) centrally formed with an oblong hole and hinged at one end thereof to an upper end of the first isolation link (31); and an isolation lever (33) adjacently positioned at one end thereof to the other end of the second isolation link (32), and adjacently and rotatably positioned at the other end thereof to the nail (17).

The base (2), partially illustrated in the drawing, forms an exterior look of the circuit breaker and incorporates various constituent components therein.

The paired stationary contactors (12) are symmetrically mounted at the base (2) for connection to a power source side and a load side, and connected to or separated from movable contactors (described later) by rotation of the movable contactors.

The paired side plates (11) are respectively and discretely disposed inside the base to support the base (2) along with other constituent components. In other words, the side plate (11) is mounted both at a front side and a rear side, although the side plate (11) is shown only in the rear side in FIG. 7. Preferably, between the paired side plates (11) there are interposed stationary contactors (12).

The lever (13) is fixedly arranged thereon with a handle (14) for manipulation by a user and showing a current wiring status. The lever (13) is rotatably hinged a lower end thereof to the side plate (11) by a lever pin (13*a*) mounted at the side plate (11). The lever (13) is fixedly mounted at one side thereof with a reset pin (13*b*) in parallel with the lever pin (13*a*).

The latch (15) is hinged to the side plate (11) for rotation by the lever (13). The latch (15) is rotatably mounted at the side plate (11) by connecting the latch pin (15*b*) to one end of the latch (15) and mounting the latch pin (15*b*) to the side plate (11).

Furthermore, the latch (15) is formed at the other end thereof with a non-slip projection (15*c*) by which the latch holder (16) is hitched to restrain the latch (15). At this time, the latch holder (16) restrains the non-slip projection (15*c*) upstream to restrain the clockwise-rotating latch (15) from rotating counterclockwise. The latch (15) is formed at the other upper end thereof with a concave curve surface (15*a*) to cause the lever (13) to rotate the latch (15) by allowing the reset pin (13*b*) to selectively contact the curve surface (15*a*). In other words, if the lever (13) rotates clockwise to move from a tripped position to a reset position, the reset pin (13*b*) is brought into contact with the curve surface (15*a*) to rotate the latch (15). The latch holder (16) is selectively restricted by a nail (17) disposed at the side plate (11). The nail (17) is rotatably disposed at the side plate (11) and simultaneously is resiliently supported by a spring (no reference numeral given). The nail (17) is rotated by one distal end of the handle (14) if the lever (13) is rotated to a reset position, i.e., rotated clockwise to a maximum. The nail (17) rotates the latch holder (16) while the latch holder (16) restrains the latch (15), thereby releasing the latch (15) from the restraint of the latch holder (16).

Meanwhile, a shaft unit (22) is interposed between the paired stationary contactors (12) mounted with movable contactors (24). The shaft unit (22) is mounted with discs (23) rotatably disposed at the side plate (11). The discs (23) are fixedly disposed with the movable contactors (24) engaged with at both ends thereof or separated from the stationary contactors (12) by rotation of the discs (23).

The shaft unit (22) may be plurally equipped according to the number of phases of supplied power source. If a plurality of shaft units (22) is disposed, rods (25*a*, 25*b*) may be disposed to penetrate each disc (23) so that the discs (23) disposed at each shaft unit (22) can communicate, and preferably, the rods (25*a*, 25*b*) are symmetrically disposed relative to a rotation center of the shaft unit (22), i.e., a first rod (25*a*) connecting a lower link (19. described later) to the shaft unit (22), and a second rod (25*b*) connecting a first isolation link (31 described later) to the shaft unit (22). An upper link (18), a lower link (19) and a main spring (21) are arranged to rotate the shaft unit (22).

The upper link (18) is rotatably disposed at one end of the latch (15). The upper link (18) is laterally formed with a stopper (18*a*) for restraining a rotational angle of the upper link (18). With the formation of the stopper (18*a*) on the upper link (18), arrangement with the lower link (19. described later) on a straight line can be prevented and the upper link (18) can be supported on the latch (15). To this end, the stopper (18*a*) is slantedly formed toward the latch pin (15*b*) from the upper link (18).

The lower link (19) is hinged at an upper end thereof to the upper link (18) through a toggle pin (20) to cooperatively work with the upper link (18), while the lower link (19) is hinged at a lower end thereof to a distal end of the shaft unit (22) through a rod. As a result, manipulating force transmitted to the upper link (18) serves to rotate the shaft unit (22) via the lower link (19) to thereby connect the stationary contactors (12) to the movable contactors (13).

Figure 10:
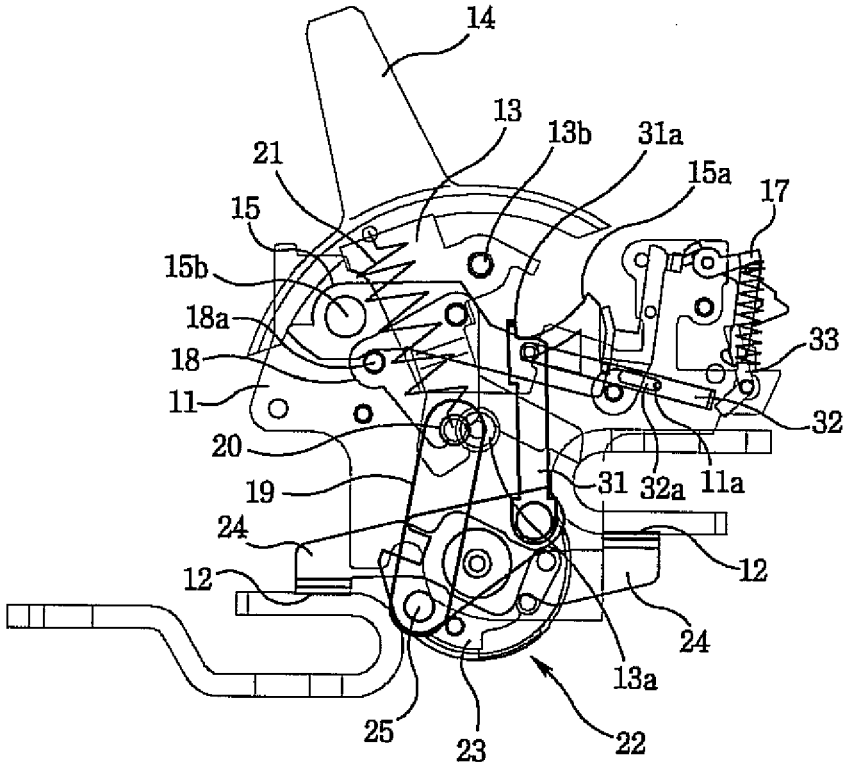
FIG. 10 is a front view illustrating a closed state of a mold cased circuit breaker.

Referring now to FIG. 10, the toggle pin (20) is biased from the lever pin (13*a*) toward the latch pin (15*b*) when the lever (13) is rotated to a closed position. In other words, if the lever pin (13*a*) is maximally rotated to the left about an imaginary line connecting the lever pin (13*a*) to a center line of the shaft unit (22), i.e., if the lever (13) is rotated to a closed position, the toggle pin (20) is so arranged as to be positioned on an area of the latch pin (15*b*) in view of the imaginary line.

The upper link (18) is formed with the stopper (18*a*) for restraining a rotational angle thereof and for being supported by the latch (15). The stopper (18*a*) prevents the toggle pin (20) from breaking away to the left by dissuading a point where the upper link (18) and the latch (15) are connected, the toggle pin (20) where the upper link (18) and the lower link (19) are connected and a point where the lower link (19) and a first rod (25*a*) are connected from being positioned on a straight line.

The main spring (21) is fixed at an upper end thereof to an upper distal end of the lever (13) and is fixed at a lower end thereof to the toggle pin (20). The main spring (21), being supplied in an extended state, exercises a tendency of elasticity of being shrunken. Accordingly, the main spring (21) pulls up the toggle pin (20) unless an external force is applied to allow the shaft unit (22) to rotate clockwise.

The first isolation link (31) is hinged at a lower end thereof to the shaft unit (22). The lower end of the isolation link (31) is hinged to a distal end of the shaft unit (22) to rotate the first isolation link (31) responsive to the rotation of the shaft unit (22).

Preferably, a second rod (25*b*) of the shaft unit (22), one of the rods comprising the rod including a first rod (25*a*), goes through a lower end of the first isolation link (31) to allow the disc (23) and the first isolation link (31) to cooperate.

Meanwhile, the first isolation link (31) is formed thereon with an upwardly-protruding lug (31*a*) to facilitate an easy contact with the lever (13). The lug (31*a*) selectively contacts a lateral surface of the lever (13) responsive to the rotational angle of the lever (13). In other words, if the lateral surface of the lever (13) contacts the lug (31*a*) from a state of FIG. 8 to that of FIG. 9, the lever (13) pushes and rotates the first isolation link (31) clockwise Accordingly, the first isolation link (31) comes to be positioned at a right side of the lever (13), whereby the lever (13) pushes an upper end of the first isolation link (31) only during a time if the lever (13) moves from a tripped state to a reset state.

The second isolation link (32) of a predetermined length is centrally formed with an oblong hole (32*a*), and is hinged at one end thereof to an upper end of the first isolation link (31) to cooperate with the first isolation link (31).

The oblong hole (32*a*) is provided to restrict and guide the operation of the second isolation link (32) during the operation of the first isolation link (31). The oblong hole (32*a*) is inserted by a guide pin (11*a*) protrusively formed from the side plate (11), such that the second isolation link (31) may slide or rotate as much as a predetermined distance about the guide pin (11*a*).

The isolation lever (33) neighbors with one end thereof to the other end of the second isolation link (32), and the other end of the isolation lever (33) neighbors with the nail (17).

The isolation lever (33) is centrally and rotatably disposed at the side plate (11).

A concrete shape of the isolation lever (33) is determined by position of the nail (17) and the second isolation link (32). For example, as illustrated in FIG. 7, both ends of the isolation lever (33) may take a rod shape to neighbor the other end of the second isolation lever (32) and the other end of the nail (17). The isolation lever (33) transmits an operational force applied by the operation of the second isolation link (32) to the nail (17) to allow the latch (15) to be released.

Meanwhile, the toggle pin (20) connecting the upper link (18) to the lower link (19) is positioned to the left (based on the drawing) from the position of the lever pin (13*a*) when the circuit breaker is in a closed position.

In other words, if the circuit breaker is in a closed state as shown in FIG. 10, the handle (14) is rotated counterclockwise to get into a closed position, and if the stationary contactors (12) and movable contactors (24) are brought into contact, the toggle pin (20) is positioned to a left area, i.e., positioned lopsidedly to the latch pin (15*b*) relative to an imaginary line connecting the lever pin (13*a*) and a center line of the shaft unit (22).

Now, an operation of the mold cased circuit breaker thus configured will be described.

Each of FIGS. 8 to 11 is a front view illustrating principal parts that shows an operational relation of the circuit breaker depicted in FIG. 7.

Figure 8:
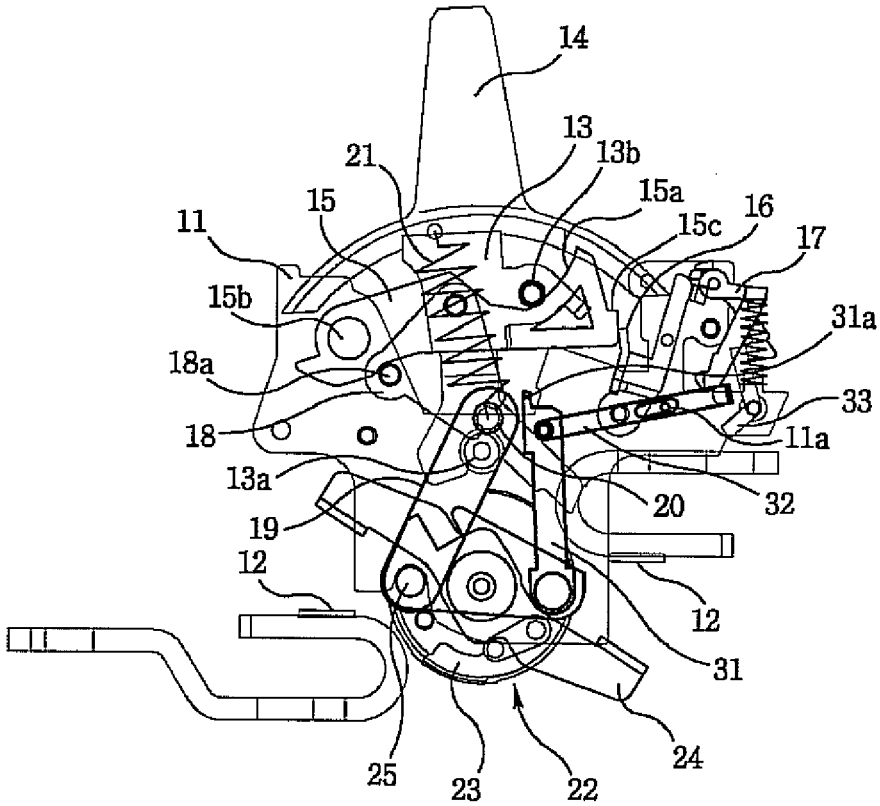
FIG. 8 is a front view illustrating a tripped state of a mold cased circuit breaker.

Referring to FIG. 8, if the circuit breaker is in a tripped state, the handle (14) is in a tripped position, and the stationary contactors (12) and the movable contactors (24) are distanced therebetween to prevent the current from flowing. This is a state where the reset pin (13*b*) formed at the lever (13) contacts a center portion of the curved surface (15*a*) of the latch (15), and the latch (15) is not restricted by the latch holder (16). Furthermore, the lug of the first isolation link (31) is spaced from the lateral surface of the lever (13) at a predetermined distance, such that the first and second isolation links (31, 32) and the isolation lever (33) are not operated.

Figure 9:
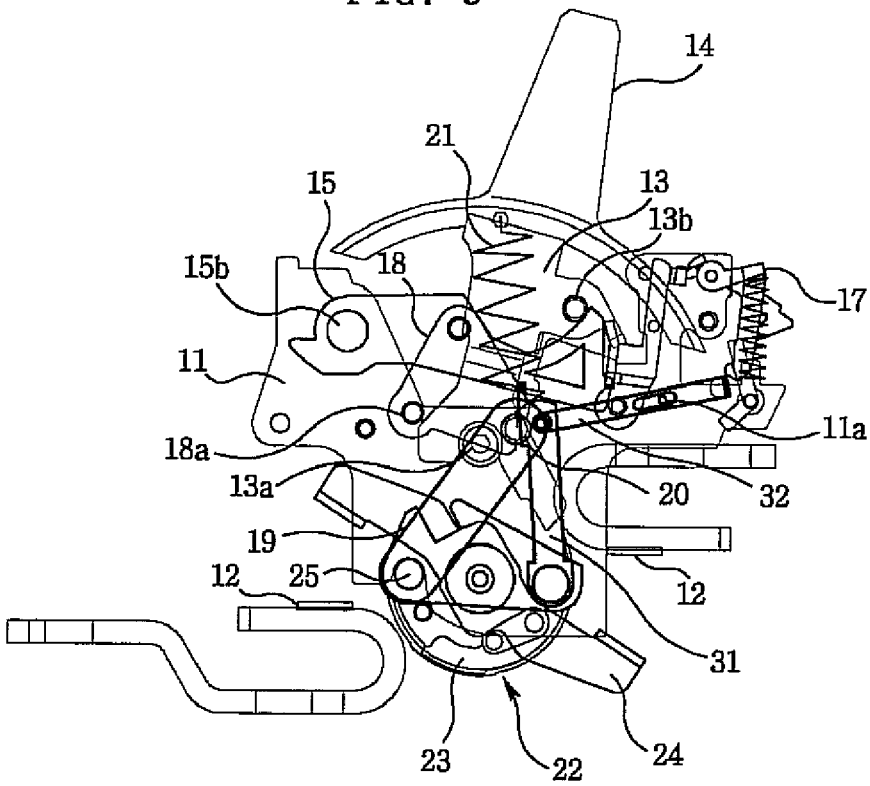
FIG. 9 is a front view illustrating a reset state of a mold cased circuit breaker.

At this time, if the handle (14) is rotated clockwise (on the drawing) in order to reset the circuit breaker as shown in FIG. 9, there is no current flowing in the circuit.

During a time lasting from a state of FIG. 8 to that of FIG. 9, the handle (14) and the lever (13) rotate clockwise to simultaneously rotate the reset pin (13*b*) formed at the lever (13) along with the lever (13), such that the reset pin (13*b*) pushes the curved surface (15*a*) of the latch (15) to rotate the latch (15) clockwise. If the latch (15) keeps rotating, the non-slip projection formed at the distal end latch (15) is inserted into the latch holder (16) to allow the latch holder (16) to restrict the latch (15), whereby the latch (15) cannot rotate in a reverse direction. At this time, elastic support of the latch holder (16) by the nail (17) prevents the latch (15) from being released from the restriction.

If the latch (15) is rotated, the upper link (18) is rotated counterclockwise to rotate the lower link (19) clockwise. Even if the lower link (19) is rotated clockwise, there is no force applied to the shaft unit (22) to prevent the shaft unit (22) from being rotated.

Although the lever (13) is rotated to contact the lugs (31*a*) formed at the lateral surface of the lever (13) and the upper end of the first isolation link (31), the first isolation link (31) is not rotated. In other words, in the process of transforming from a state of FIG. 8 to that of FIG. 9, the stationary contactors (12) and the movable contactors (24) are distanced therebetween to lower the first isolation link (31), such that the first isolation link (31) is not allowed to rotate even though the lever (13) is rotated.

In order to allow a closed circuit to get conductive again while the circuit breaker is reset to distance the stationary contactors (12) and the movable contactors (24), the handle (14) is rotated counterclockwise to set the circuit breaker in a closed state.

Referring back to FIG. 10, in order to let the circuit breaker staying in a closed state, the handle (14) of FIG. 9 is rotated counterclockwise, If the handle (14) is rotated counterclockwise, the handle (14) and the lever are rotated counterclockwise, but the latch (15) is not rotated due to restriction by the latch holder (16) and the latch (15) keeps the restricted state by the latch holder (16).

If the handle (14) and the lever (13) are maximally rotated to the left, the main spring (21) whose upper end is fixed to the lever (13) pulls the toggle pin (20). If the main spring (21), which is supplied with an elongated state and now has a tendency of being shrunken, pulls the toggle pin (20), the upper link (18) is made to rotate clockwise and the lower link (19) is made to rotate counterclockwise to allow both links (18, 19) to get nearly straightened up. At this time, although the lever (13) connected to the upper end of the main spring (21) is not pulled by the lever pin (13*a*) secured to the side plate (11), the toggle pin (20) is pulled by the main spring (21) because the toggle pin (20) is just a constituent element connecting the upper link (18) to the lower link (19).

Once the state of FIG. 9 is transformed to that of FIG. 10 to allow the circuit breaker to be in a closed state, the upper link (18) is rotated clockwise to rotate the lower link (190 counterclockwise, and the lower link (19) pushes the shaft unit (22) for counterclockwise rotation to cause the stationary contactors (12) and the movable contactors (24) to be in touch, thereby allowing the circuit to be conductive.

Under the above circuit state, there may arise an incident where the movable contactors (24) and the stationary contactors (12) are brought into a fused-like engagement state, or are in an inseparable state where the movable contactors (24) cannot be separated from the stationary contactors (12) due to other causes.

At this time, the handle (14) is made to rotate clockwise to forcibly separate the stationary contactors (12) from the movable contactors (24) and the circuit breaker is made to be in a tripped state or a reset state to thereby interrupt the circuit.

Figure 11:
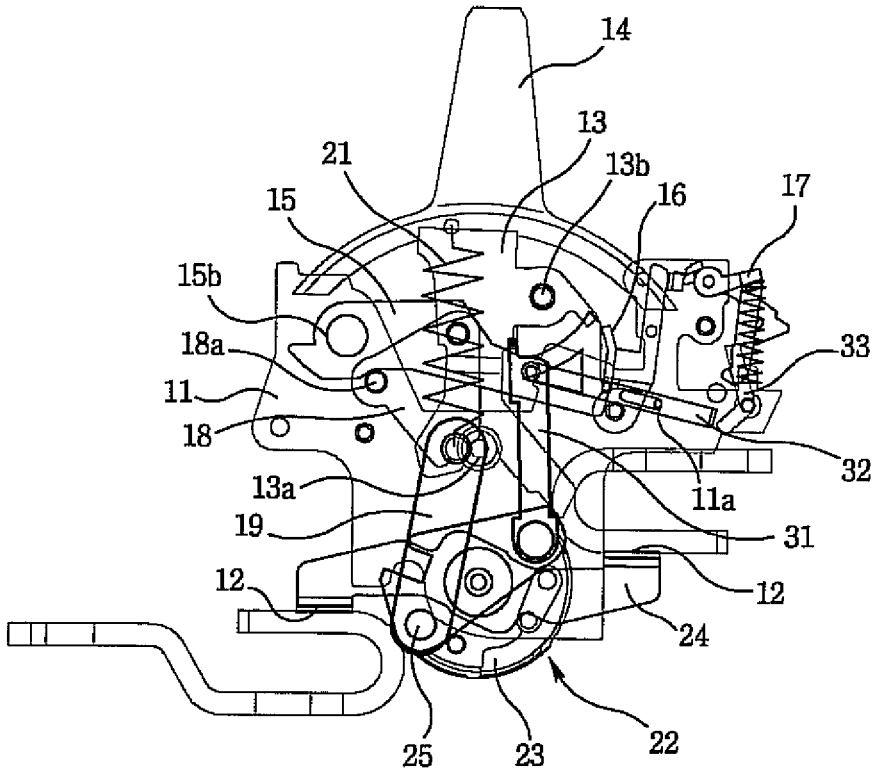
FIG. 11 is a front view illustrating an isolated state of a mold cased circuit breaker.

To this end, if the handle (14) is rotated clockwise, a close state of the circuit breaker of FIG. 10 is transformed to a tripped state of the circuit breaker of FIG. 11. If the circuit breaker is transformed to the tripped state of FIG. 11, the lever (13) laterally contacts the lug (31*a*) at the upper side of the first isolation link (31). Under this state, the stationary contactors (12) and the movable contactors (24) of the shaft unit (22) are brought into contact to lift the first isolation link (31).

In the case where the first isolation link (31) is lifted, the lug (341*a*) formed at the first isolation link (31) is positioned within a rotation region of the lever (13), such that the upper end of the first isolation link (31) is affected by the operation of the lever (13). In other words, in the state of FIG. 9, although the lug (31*a*) of the first isolation link (31) is brought into contact with the lever (13), the first isolation link (31) does not interfere with the lever (13) as the lever (13) is not located within the rotation region. Meanwhile, in FIG. 11, the upper end of the first isolation link (31), i.e., the lug (31*a*), comes to be positioned within the rotation region of the lever (13) to cause the first isolation link (31) to contact an external surface of the lever (13), whereby the lever (13) pushes the lug (31*a*) to a rotation direction in the midst of rotating process. If the lever (13) pushes the lug (31*a*), the first isolation link (31) is rotated clockwise about the lower end thereof.

If the first isolation link (31) is rotated clockwise, the latch is detached from the latch holder (16) to come to an initial tripped state as shown in FIG. 8. In other words, the handle (14) is on a tripped position and the stationary contactors (12) and the movable contactors (24) are in a state of being separated. Furthermore, if the first isolation link (31) is rotated clockwise, the first isolation link (31) pushes the second isolation link (32) to the right. Because the guide pin (11*a*) protruded on the side plate (11) is inserted into the oblong hole (32*a*) formed at the second isolation link (32), the second isolation link (32) is moved from the left to the right side, with the guide pin (11*a*) being inserted in the oblong hole (32*a*).

If the second isolation link (32) is moved from the left to the right side, the other end of the second isolation link (32) rotates an isolation lever (33) counterclockwise. If the other end of the second isolation link (32) is brought into contact with one end of the isolation lever (33), the isolation lever (33) is rotated counterclockwise about a hinged part, whereby the nail (17) is rotated counterclockwise by the other end of the isolation lever (33). If the nail (17) is rotated counterclockwise, the nail (17) cannot support the latch holder (16) any longer to allow the latch holder (16) to rotate clockwise. If the latch holder (16) is rotated clockwise, the latch holder (16) cannot restrict the latch (15) any more to leave the latch in a free state.

If the latch (15) is left in a free state, the main spring (21) pulls the toggle pin (20) as shown in FIG. 8 to allow the upper link (18) to tightly contact the latch (15), and the lower link (19) is lifted upward to cause the shaft unit (22) connected to the lower end of the lower link (19) to rotate clockwise.

Once the shaft unit (22) is rotated clockwise to forcibly separate the movable contactors (24) from the stationary contactors (12), the circuit breaker returns to the initial tripped state as shown in FIG. 8 to protect the circuit and prevent a user from being struck by electricity during work due to his or her carelessness.

As apparent from the foregoing, there is an advantage in the mold cased circuit breaker thus described according to the present disclosure in that the circuit breaker is forcibly tripped to allow stationary contacts to be separated from movable contactors, thereby protecting the circuit against an electrical overload. A circuit operating state and a state indicated by the circuit breaker are identified during an electrical overload to enable a user to correctly discern the circuit state, thereby preventing a safety failure problem beforehand.

What is claimed is:

1. A mold cased circuit breaker comprising: a pair of stationary contactors respectively connected to a power source side and a load side within a base on a point symmetric alignment; a pair of side plates each spaced at a predetermined distance apart on the base with the stationary contactors being positioned therebetween; a lever secured at a top end thereof with a handle, rotatably mounted on the side plates and manipulated in a closed state, a tripped state and a reset state; a latch rotatably mounted at one end thereof on the side plates, and rotated by the lever if the lever moves to a reset condition; a latch holder rotatably mounted on the side plates and selectively restraining the other end of the latch; a nail rotatably mounted on the side plates, resiliently supported to the side plates and selectively restraining the latch holder; a shaft unit mounted with movable contactors selectively connected at both ends thereof to the stationary contactors by rotation, discretely arranged from the lever at a lower section of the lever, and rotatably mounted between the pair of the stationary contactors; an upper link hinged at an upper end thereof to the latch; a lower link hinged at an upper end thereof to a lower end of the upper link via a toggle pin, and hinged at a lower end thereof to the shaft unit; a main spring secured at an upper end thereof to an upper end of the lever and secured at a lower end thereof to the toggle pin; and contactor separation means separating the movable contactors from the stationary contactors by cooperating with the lever if the movable contactors and the stationary contactors are engaged; wherein the contactor separation means comprises: a first isolation link hinged at a lower end thereof to the shaft unit and selectively engaged at an upper end thereof with a lateral surface of the lever; a second isolation link centrally formed with an oblong hole accommodating a guide pin protruded on the side plate and linked at one end thereof to an upper end of the first isolation link; and an isolation lever adjacently positioned at one end thereof to the other end of the second isolation link, and so positioned at the other end thereof as to selectively engage with the nail, and rotatably mounted at the side plates to rotate the nail by way of operation of the second isolation link.

2. The circuit breaker as claimed in claim 1, wherein the first isolation link is formed at an upper end of the first isolation link with a lug contacting a lateral surface of the lever when the lever is rotated to a reset position.

3. The circuit breaker as claimed in claim 1, wherein the shaft unit comprises: a disc rotatably mounted on the side plate; movable contactors laterally mounted at the disc and selectively engaged at both ends thereof with the pair of stationary contactors by rotation; and a pair of rods mounted relative to a rotation center of the disc by penetrating the disc and the movable contactors.

4. The circuit breaker as claimed in claim 3, wherein the pair of rods comprises: a first rod that comes adjacent to the handle if the handle is placed in a closed position; and a second rod symmetrically arranged relative to a rotation center of the first rod, wherein the lower link is pierced at a lower end thereof by the first rod, and the first isolation link is pierced at a lower end thereof by the second rod.

5. The circuit breaker as claimed in claim 1, wherein the latch holder restricts the other end of the latch when the latch is rotated downward at the other end by the lever.

6. The circuit breaker as claimed in claim 5, wherein the nail restricts the latch holder when the latch holder restrains the latch.

7. The circuit breaker as claimed in claim 5, wherein the nail releases the latch holder by rotation of the isolation lever.

8. The circuit breaker as claimed in claim 1, wherein a lever pin is mounted at a lower end of the lever for connecting the lever to the side plate, and the side plate is mounted with a latch pin for connecting one end of the latch and the side plates, and toggle pin is positioned between the lever pin and the latch pin when the lever is moved to a closed position.

9. The circuit breaker as claimed in claim 1, wherein the upper link is lopsidedly formed with a stopper toward the latch pin for preventing the upper link and the lower link from being positioned on a straight line and for supporting the upper link.

* * * * *